United States Patent [19]

Reinhall et al.

[11] Patent Number: 4,614,304

[45] Date of Patent: Sep. 30, 1986

[54] ROTOR/MIXER FOR CONTROLLING MIXING AND REFINING OF PULP MATERIAL

[75] Inventors: Rolf Reinhall; Johan I. Johansson, both of Bellevue, Wash.

[73] Assignee: Sunds Defibrator AB, Sundsvall, Sweden

[21] Appl. No.: 677,827

[22] Filed: Dec. 4, 1984

[51] Int. Cl.[4] ..... B02C 19/12

[52] U.S. Cl. ..... 241/28; 241/37; 241/259.2

[58] Field of Search ..... 241/28, 259.2, 259.1, 241/37, 259.3, 246, 247

[56] References Cited

U.S. PATENT DOCUMENTS 3,547,356 12/1970 Asplund ..... 241/28

4,275,852 6/1981 Asplund ..... 241/37 X

*Primary Examiner*—Mark Rosenbaum

*Attorney, Agent, or Firm*—Eric Y. Munson

[57] ABSTRACT

A system for mixing and refining pulp in which the raw material is conveyed into a cylindrical drum and propelled therethrough in linear/spiral direction by a co-axial rotor comprising a plurality of mixing/refining elements. The raw material is mixed and refined during the relative rotation between the rotor and the drum in a plurality of co-axially extending grinding areas defined between rotatable grinding elements on the rotor and a facing grinding surface on the interior of the drum while being simultaneously compressed therein and alternately decompressed in areas between the grinding areas. The rotatable elements are adjustably mounted to the rotor so as to vary the spacing between the grinding surface on the interior of the drum and a rotatable grinding surface on the grinding elements, while simultaneously adjusting the material feeding angle of the grinding areas. The adjustment can be achieved mechanically or by a hydraulic system during the operation of the apparatus to control and vary the flow of the pulp material as it passes through the grinding areas to insure optimum and even mixing and refining of the pulp.

8 Claims, 5 Drawing Figures

ROTOR/MIXER FOR CONTROLLING MIXING AND REFINING OF PULP MATERIAL

FIELD OF THE INVENTION

The present invention relates to a refining system, particularly for refining pulp material derived from vegetable lignocellulosic substance for the production of paper products and the like. The starting material is, in the case of wood, reduced to a mass of chips which may be pretreated in a conventional manner to form a raw material of unrefined pulp which is not yet in suitable condition for the production of paper. The raw material is introduced into a cylindrical refining region where it is processed between the working surfaces of an internal rotor and a surrounding stator as it moves through the refining region in a direction parallel to the rotor axis.

BACKGROUND OF THE INVENTION

Drum refiners of the general type discussed above are known to the prior art, U.S. Pat. No. 4,275,852 describes the general operation of such drum refiners. Unrefined pulp material introduced into a cylindrical drum is propelled therethrough in rapid pulsating succession while being subjected to a wedging action as it is accelerated by the centrifugal force exerted by the wings. Rotating wings exert a force in a linear/radial direction on the material, causing it to become compacted into wedge-shaped clumps, As explained more fully in the afore-mentioned U.S. Pat. No. 4,275,852, a plane of shear created a short distance from the leading edge of the wings breaks up the fiber bundles, and the refining action takes place when shearing forces are induced between the rotating clumps of pulp which are held back by friction generated against the interior drum surface. However, a separate blade element is mounted along one surface of each wing, and the edge of the blade closest to the drum surface may be deflected relative to the fixed wing. Deflection of this leading edge of the blade results in angular adjustment of the blade relative to the inner surface of the drum.

U.S. Pat. No. 3,547,356 discloses a drum refiner in which rotatable blades are designed to remain at a fixed distance during the refining action. The gap between the blades and the inner surface of the cylindrical drum is adJusted in part by adjustable cams mounted on the inner surface of the cylindrical drum.

U.S. Pat. No. 4,199,114 also discloses a drum refiner in which the gap between a rotatable impeller and a series of shear members in the inner surface of the cylindrical drum is regulated by staves adjustably mounted to the inner surface of the drum, the linear movement of the pulp material through the drum being controlled by a series of plow members.

U.S. Pat. Nos. 1,951,519, 2,216,612 and 3,806,050 provide further illustrations of known drum refiners. In U.S. Pat. No. 1,951,519, a bed plate fitted with a plurality of bars or knives is adjustably mounted to the inner surface of the drum so as to selectively adjust the gap between the inner surface of the drum and a rotor having a plurality of knives.

U.S. Pat. No. 2,216,612 discloses a drum refiner including a rotor having fixed arms. Knives mounted to the end of the arms are slidably adjustable relative to the inner surface of the drum by removing a locking bolt and then by turning an adjustment bolt.

U.S. Pat. No. 3,806,050 discloses a drum refiner in which interchangeable blocks having a plurality of teeth are arranged in desired patterns to accomplish optimum mixing and refining.

It is among the objects of the present invention to provide an improved mixing/refining system in which the drum refiner includes means for repeated high frequency compression of the pulp material in a radial direction as well as in a linear direction.

SUMMARY OF THE INVENTION

The present invention contemplates a mixing/refining system which includes a cylindrical drum surrounding a rotor comprising a plurality of rotatable mixing/refining tools referred to herein as mixing/refining shoes, extending co-axially about the rotor and which are individually adjustable so as to vary the grinding areas defined between the interior surface of the drum and the exterior surface of each mixing/refining shoe while simultaneously adjusting the material feeding angle thereof. The exterior surface of each mixing/refining shoe is provided with a grinding surface which works against a grinding surface on the interior of the drum. The adjustment may be made mechanically or by means of a hydraulic system incorporated in the apparatus to control the flow of material through the grinding areas and the mixing/refining thereof in response to variable energy demands.

Thus the grinding effect resulting from the present invention may be comparable to the adVantageous effect achieved by disc refiners, without the disadvantageous effect of the powerful centrifugal force of acceleration generated by the rotating discs, which force may vary between 2800 g's and 12,000 g's, with consequent risk of unrefined fiber material passing through the grinding space.

For a better understanding of the present invention, it should be explained that the fibers have a diameter of only some hundredths of a millimeter. Therefore, in disc refiners, the spacing between the grinding elements must be extremely narrow, such as of some tenths of a millimeter, so that these hair-like fibers can be firmly gripped between the rotating grinding surfaces, with consequent risk of excessive wear of and damage to the grinding elements. This risk is substantially avoided by the use of the drum type refiner, in which the grinding space clearance may range between one millimeter and two millimeters, while still producing a satisfactory shearing action and fibrillation of the fibers.

DESCRIPTION OF THE PREFERRED EMBODIMENTS

Figure 1:
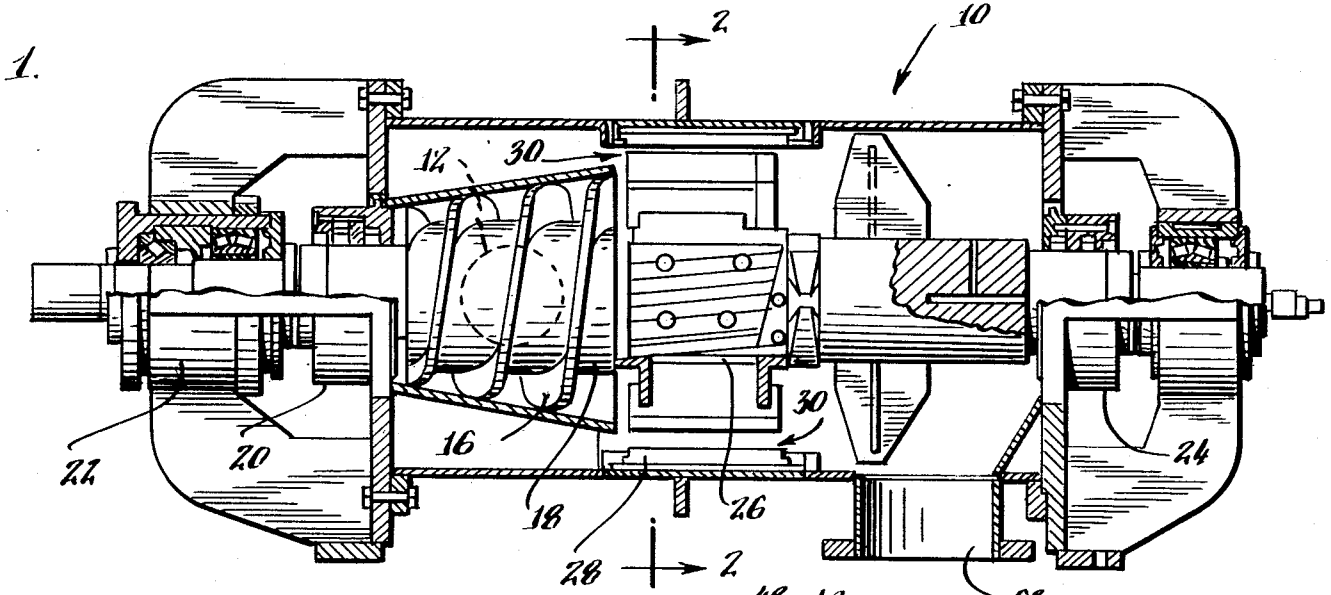
FIG. 1 is a schematic view of a drum type refiner according to the present invention, shown partially in longitudinal section.
Figure 2:
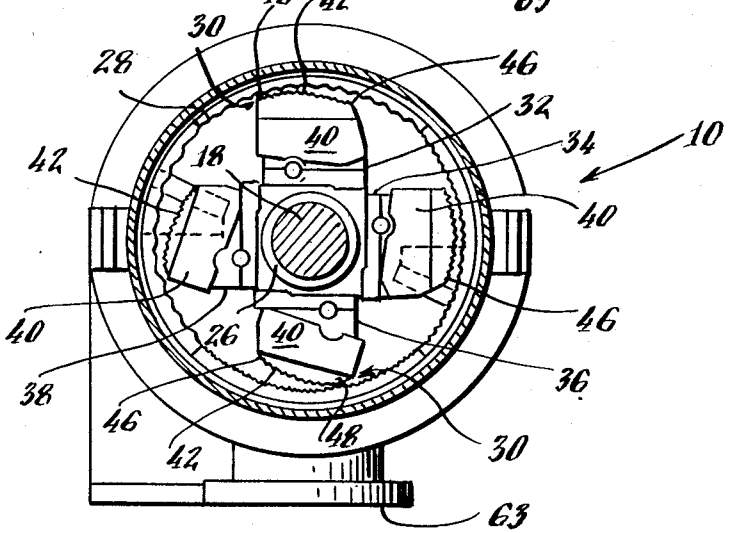
FIG. 2 is a sectional view of FIG. 1 as seen along directional arrows 2—2 of FIG. 1.
Figure 3:
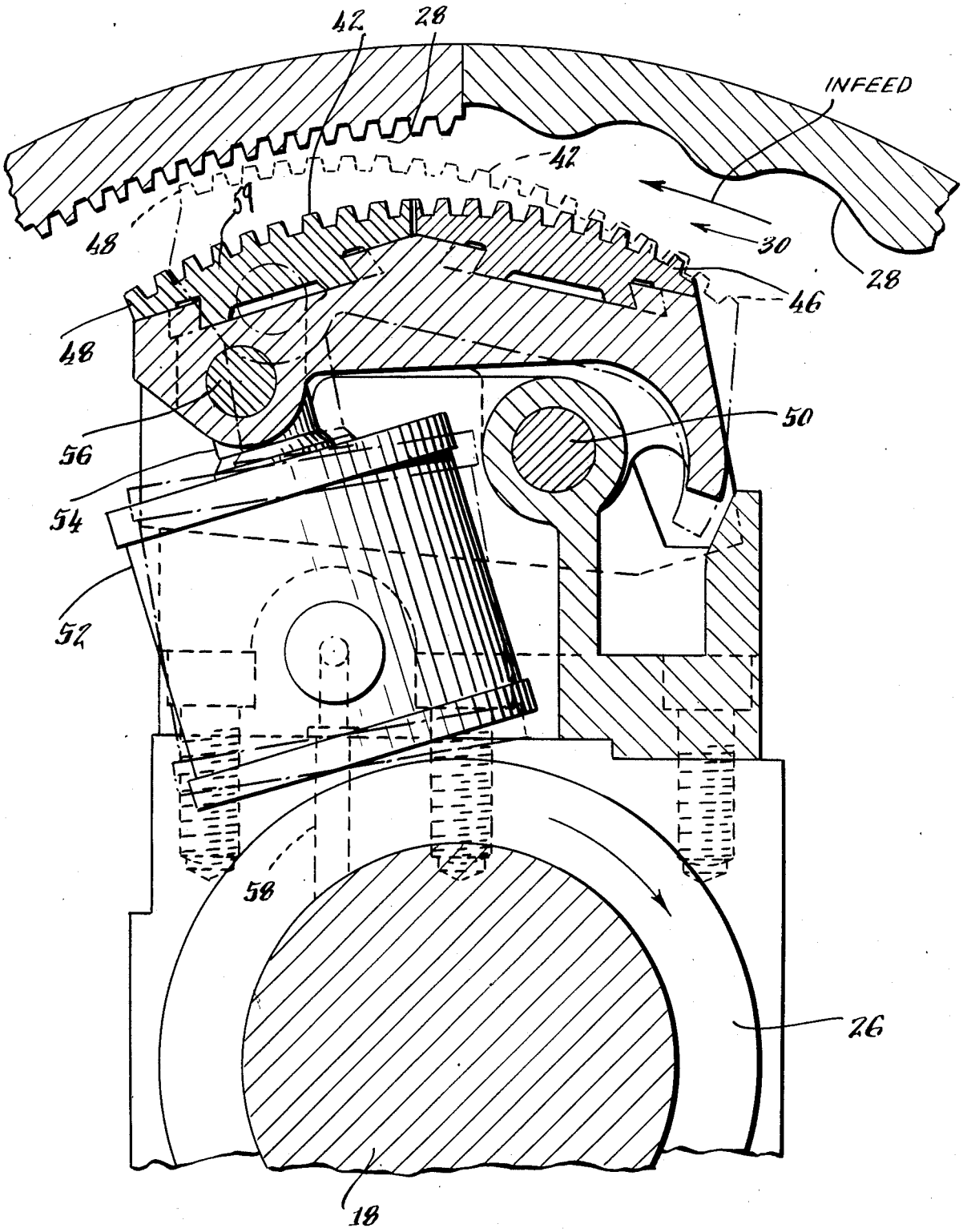
FIG. 3 is a partial detailed section of the drum, the rotor and a refining shoe, articulately mounted to the rotor.

Referring to FIGS. 1–3 of the drawings, a cylindrical drum is designated by the reference numeral 10. The pulp material to be refined is introduced into the drum through inlet opening 12 and is conveyed in a linear direction therethrough by a feed screw conveyor 16. The refined pulp is discharged through the outlet 63. The feed screw conveyor is mounted to and rotatable with a shaft 18 which extends coaxially and longitudinally through the center portion of the drum. A motor 20 is provided to rotate the shaft which is journaled in bearings 22 and 24. A rotor, designated generally by reference numeral 26, is mounted to and is rotatable with the shaft 18. The interior surface of the drum surrounding the rotor includes grinding surfaces which may be in the form of conventional grinding segments, designated by reference numeral 28. An annular grinding space 30 is defined between the grinding surface 28 on the interior surface of the drum and the grinding segments of each of the mixing/refining shoes 40 carried by the rotor 26. As is shown in greater detail in FIG. 2, the rotor 26 includes four radially directed rotor legs designated by reference numerals 32, 34, 36 and 38. Each mixing/refining shoe is articulately mounted to each rotor leg, as will be discussed in greater detail herein.

The general construction and assembly of a drum refiner to which the invention is applicable is more fully described and illustrated in the aforementioned U.S. Pat. Nos. 4,275,852 and 3,547,356, to which reference is made. In operation, the pulp material fed into the cylindrical drum by the feed screw conveyor 16 is propelled radially outwards towards the stationary grinding surfaces on the interior of the drum by the spinning action of the rotor, while being moved in a spiral/linear direction through the drum by the action of the rotating mixing/refining shoes. As the pulp material is continually being moved towards the interior surfaces of the drum, it becomes compressed between the stationary grinding surface 28 on the interior of the drum and the mixing/refining shoes 40 as it is forced through the grinding spaces 30. The rotor normally rotates at a linear speed ranging from 15 meters per second to 100 meters per second, and the force exerted on the pulp material is controlled by the hydraulic piston. The width of the grinding gap 30 between the rotor and the inner surface of the drum may vary between 0.1 of a millimeter and 5 millimeters. Thus, the mixing/refining of the pulp occurs as a result of the pulp material being repeatedly compressed and decompressed as it is forced through the adjustable grinding spaces 30 while simultaneously being subjected to a grinding action between the stationary grinding surface 28 on the interior surface of the drum and the rotating grinding segments of the rotating mixing/refining shoes 40. The refined pulp is discharged through the discharge port 63, proximate to the location where the refined pulp exits from the grinding spaces 30. Impeller means 64 direct the refined pulp towards the discharge port 63. A conventional discharge valve (not shown) may be installed in the discharge port 63 to regulate the amount of pulp material accumulating in the drum. Inlets (not shown) may be provided for the introduction of steam and various pulp-treating agents known to the art which are introduced into the drum during the refining and mixing operation.

Referring to FIGS. 2 and 3, as noted above, each mixing/refining shoe 40 is mounted to the four rotor legs 32, 34, 36 and 38. Each mixing/refining shoe 40 is an integral unit having one segment 42 directly opposed to and facing the surrounding stationary cylindrical grinding surface 28 on the interior surface of the drum. Preferably, the mixing/refining shoes with their grinding segments are shaped so as to define a 15° feeding angle in the axial direction away from the feed-in end to promote the spiral/linear movement of the pulp material through the drum. Each mixing/refining shoe 40 includes a leading or feeding flank 46 and a trailing flank 48. The mixing/refining shoes are pivotally mounted to their respective rotor legs at a point proximate to their feeding flanks 26 and are designated by reference numeral 50. A hydraulic cylinder 52 is mounted to each of the rotor legs and has a piston 54 pivoted at 56 to the trailing flank 48 of each mixing/refining shoe. A hydraulic fluid line for supplying fluid to the cylinder 52 is designated by reference numeral 58.

As will be apparent, selective adjustment of the grinding space between the grinding segments of the mixing/refining shoes and the grinding surface 28 on the interior of the drum is provided by actuation of the hydraulic cylinder and piston. In retracted position of the piston 54, as shown in FIG. 3, the maximum grinding gap clearance is defined between the trailing edge of the grinding segment of the mixing/refining shoe and the grinding segment 28 on the interior surface of the drum. When hydraulic fluid is pumped into the cylinder, the consequent extension of the piston will cause the feeding flank of the mixing/refining shoe to rotate about pivot point 50 and to move the trailing flank 48 radially towards the stationary grinding surface on the interior of the drum. The minimum gap clearance is achieved when the piston 54 is fully extended. As shown in phantom in FIG. 3, the grinding space 30 has a quasi-wedge configuration and tapers in a direction from the feeding flank of each mixing/refining shoe 40 to the trailing edge thereof. The mixing/refining shoes rotate in a clockwise direction as shown in FIG. 3, and, thus, the pulp material fed into the inlet of the grinding space is forced into a quasi-wedged configuration. The maximum and minimum clearance gap and all intermediate gap clearances are, therefore, controlled by the degree of extension of the hydraulic piston from its hydraulic cylinder while the feeding angle for the pulp material into the grinding space is simultaneously adjusted as the leading flanks of the mixing/refining shoes rotate about their pivot points 50. It is apparent that the gap clearance may be readily adjusted even when the refiner is in operation. Moreover, because each mixing/refining shoe is provided with its separate piston and cylinder, each mixing/refining shoe may be adjusted individually and independently of the other mixing/refining shoes.

Preferably, as disclosed in FIG. 3, the outer surface of the mixing/refining shoe includes a grinding segment 59 defined on at least a portion of this surface.

It will be understood from the foregoing that the invention discloses a novel concept in the drum refining process by providing means for repeated high frequency compressions in a radial direction as well as in an axial direction. This novel concept of refining greatly improves the mixing efficiency of the system and, at the same time, permits a combination of mixing and decompressing steps, as well as refining at high consistencies such as on the order of 25% to 40%, as compared to 2% to 6% in conventional drum refiners.

Figure 4:
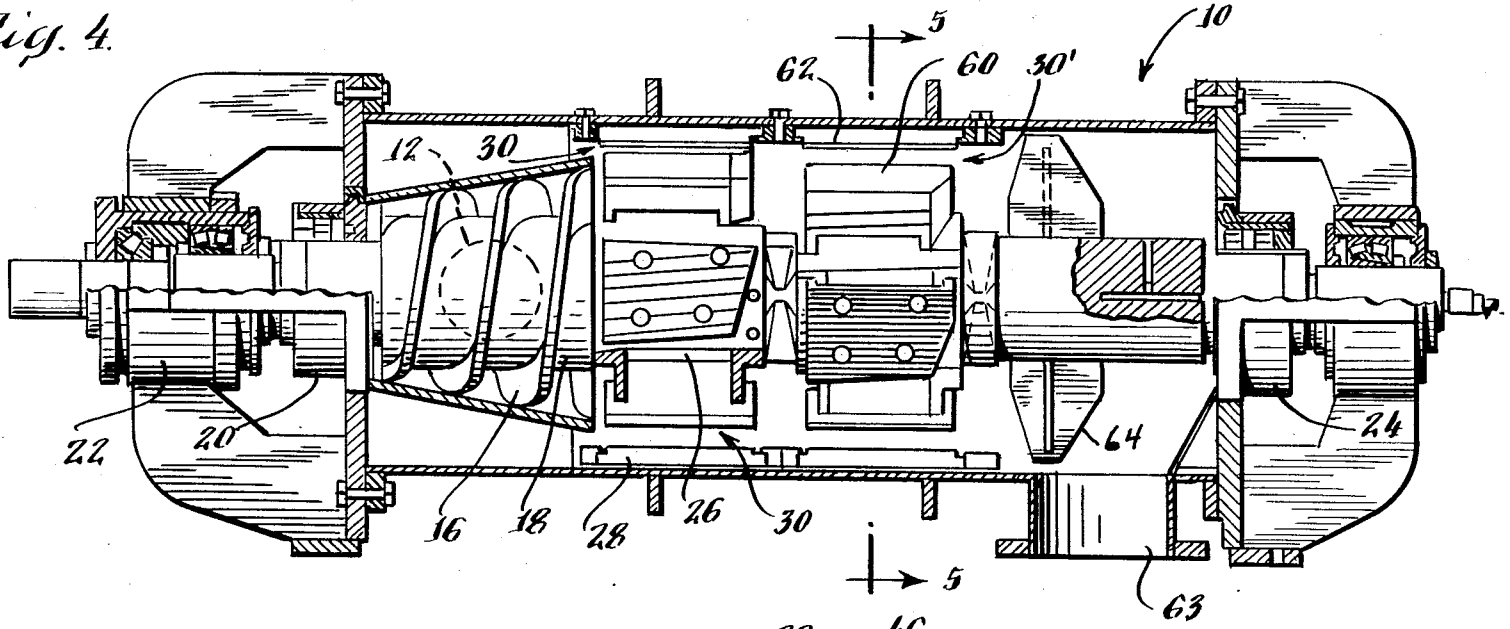
FIG. 4 is a schematic view similar to FIG. 1, showing a drum refiner comprising two sections of a mixing/refining shoe assembly.
Figure 5:
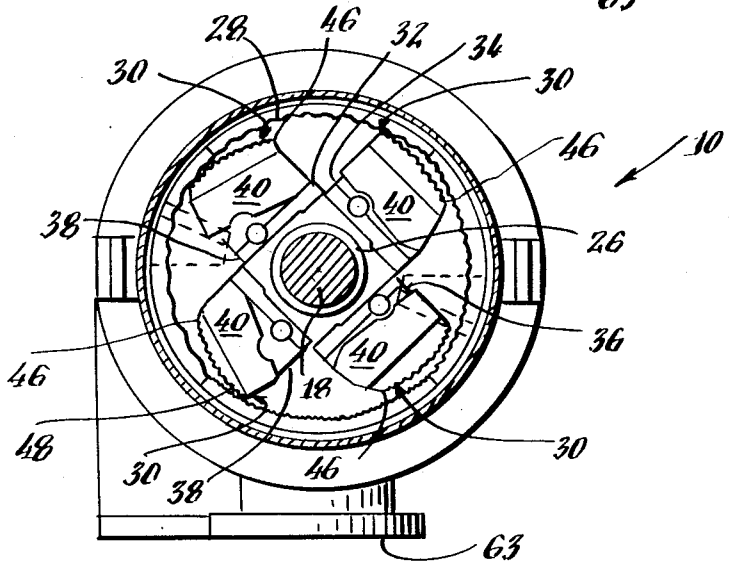
FIG. 5 is a sectional view of the drum refiner of FIG. 4 as seen along directional arrows 5—5 of FIG. 4.

Referring to FIGS. 4 and 5 of the drawings, similar reference numerals have been used to identify corresponding elements. The basic difference between the FIGS. 1 and 4 embodiments is that in the FIG. 4 embodiment, the drum refiner includes two separate sections of mixing/refining shoes. More specifically, the refiner of FIG. 4 is provided with a second rotor designated by reference numeral 60, which is positioned downstream from the first rotor 26 and includes four radially-directed rotor legs similar to those of rotor 26. To each of these rotor legs is mounted an adjustable mixing/refining shoe 40 which functions in a manner identical to the mixing/refining shoes of the second rotor, and the surrounding grinding segments on the interior surface of the drum define a second grinding space 30' between the grinding segments of each mixing/refining shoe and a facing cylindrical grinding segment, through which the pulp material to be refined must pass before it can be discharged from the drum refiner. Thus, the FIG. 4 embodiment of the refiner provides two separate mixing/refining stations within the drum, and the grinding spaces 30 and 30' of the two respective stations may differ. The provision of a second or multiple grinding stations is advantageous for certain types of refining operations such as high-consistency, non-cutting, frictional refining for a wide range of raw materials such as kraft knotted pulp, screen rejects, fluff-dried pulp and waste paper with plastic impurities, as well as being useful for various mixing operations.

Although the adjustment of the mixing/refining shoes 40 described and shown herein is achieved hydraulically, it should be understood that the adjustment may be made manually or mechanically without departing from the invention.

The discussion of the drum refiner embodiments herein is intended to be illustrative only and not restrictive of the scope of the invention, that scope being defined by the following claims and all equivalents thereto.

We claim:

1. Apparatus for mixing and refining pulp material in a refining region defined between a rotor and a surrounding drum as the pulp material is moved through a refining region by the effect of the relative rotational movement between the rotor and the drum, characterized by:

a plurality of mixing/refining elements carried by said rotor and defining a plurality of co-axially extending compression/grinding areas between said rotor and said drum and intermediate decompression areas, said mixing/refining elements comprising a rotatable grinding surface extending from a leading flank to a trailing flank for working against a facing grinding surface on the interior of said drum;

said rotatable grinding surfaces being designed to comprises the pulp material as it is passed from a feed-in opening defined between said leading flank and said facing grinding surface to an outlet gap defined between said trailing flank and said facing grinding surface and allow the compressed material to be passed into said decompression areas during the rotation of said mixing/refining elements;

said mixing/refining elements being articulately mounted to said rotor to permit variations of the clearance between said rotatable surfaces and said facing grinding surfaces while simultaneously adjusting the material feeding angle of said compression/-grinding area.

2. Apparatus according to claim 1, including means for selectively and indenendently moving said mixing/refining elements to vary said clearance and said material feeding angle.

3. Apparatus according to claims 1 or 2, in which the mixing/refining elements are movable about a pivot point adjacent to the leading flank of said mixing/refining elements.

4. Apparatus according to claim 3, including means for moving the trailing flanks of said mixing/retaining elements about said pivot points towards and away from said facing grinding surface.

5. Apparatus according to claim 4, in which said means for moving said trailing flanks includes a hydraulic piston connected to said trailing flanks.

6. Apparatus according to claims 1, 2 or 3, in which said rotatable grinding surfaces include grinding segments.

7. The method of mixing and refining pulp material in a refining region defined between a rotor and a surrounding drum as the pulp material is moved through the refining region by the effect of the relative rotational movement between the rotor and the drum, characterized by:

subjecting the pulp material to repeated compression steps and alternating decompression steps while it is passed through a plurality of spaced compression/-grinding areas and intermediate decompression areas during the rotation of the rotor;

said compression/grinding areas forming a clearance gap between the interior surfaces of the rotor and the drum and extending between a leading flank and a trailing flank thereof, permitting passage of the pulp material into said intermediate decompression areas and regulating the clearance gap while simultaneously adjusting the angle of passage of the material through the compression/grinding areas in response to variation in energy demand.

8. The method according to claim 7, in which the clearance gap and the angle of passage of the pulp material are regulated by rotating the leading flanks of the grinding areas about a fixed pivot point on the rotor, while moving the trailing flank in a direction towards the interior surface of the drum.

* * * * *